United States Patent [19]

Sullinger

[11] 4,449,252

[45] May 22, 1984

[54] PROTECTIVE GARMENT FOR A BOWLER

[76] Inventor: JoAnn J. Sullinger, 514 N. 76th St., Omaha, Nebr. 68114

[21] Appl. No.: 394,276

[22] Filed: Jul. 1, 1982

[51] Int. Cl.[3] ..... A41D 27/12

[52] U.S. Cl. ..... 2/46

[58] Field of Search ..... 2/46, 48, 49, 52

[56] References Cited

U.S. PATENT DOCUMENTS

| | | | |
|---|---|---|---|
| 2,499,689 | 3/1950 | Sossman | 2/49 |
| 2,567,524 | 9/1951 | Morganti | 2/49 |
| 2,665,426 | 1/1954 | Schmidt . | |
| 2,727,239 | 12/1955 | Simon | 2/49 R |
| 3,045,245 | 7/1962 | Kohen | 2/227 |
| 3,174,156 | 3/1965 | Dale | 2/49 |
| 4,050,099 | 9/1977 | David | 2/46 |

*Primary Examiner*—Doris L. Troutman

*Attorney, Agent, or Firm*—Zarley, McKee, Thomte, Voorhees & Sease

[57] ABSTRACT

A protective garment for a bowler is described including a generally rectangular towel member having upper and lower ends adapted to be positioned over one of the bowler's breasts and generally extending from the bowler's shoulder to the bowler's waist. A first elongated strap member is secured at one end to the rectangular member above the lower end and is adapted to be extended around the bowler's waist and detachably secured at its other end to the rectangular member. A second elongated strap member is secured at one end to the upper end of the rectangular member and is adapted to extend over the bowler's shoulder and thence downwardly for connection, at its other end, to the first strap member intermediate the ends thereof. The rectangular towel member prevents dirt or the like carried by the bowling ball from being transmitted to the bowler's shirt beneath the rectangular towel member.

4 Claims, 2 Drawing Figures

PROTECTIVE GARMENT FOR A BOWLER

BACKGROUND OF THE INVENTION

This invention relates to a protective garment and more particularly to a protective garment for a bowler.

Bowlers commonly pick up the bowling ball from the ball return area and grasp the same in both hands prior to placing the fingers of the throwing hand in the holes of the ball. When the ball is grasped with both hands, the ball is commonly rested against the chest or breast of the bowler. The dirt and debris carried by the bowling ball is thereby transferred to the bowler's shirt frequently causing the same to become an unsightly mess.

Therefore, it is a principal object of the invention to provide a protective garment for a bowler which prevents the bowler's shirt from becoming dirty.

A further object of the invention is to provide a protective garment for a bowler which may be easily positioned on the bowler.

A further object of the invention is to provide a protective garment for a bowler which does not interfere with the bowler's delivery.

Still another object of the invention is to provide a protective garment for a bowler which is washable.

These and other objects will be apparent to those skilled in the art.

SUMMARY OF THE INVENTION

A protective garment is described which is adapted to be detachably positioned on the bowler to prevent dirt from the bowling ball from being transmitted to the bowler's shirt. A washable towel member is positioned over the chest area of the bowler and generally extends from the shoulder to the waist area of the bowler. A first elongated strap member is secured to the towel member at one end and extends around the bowler's waist and is connected at its other end to the towel member. A second strap member is secured at one end to the upper end of the towel member and extends over the bowler's shoulder and thence downwardly for connection with the first strap member. When the garment is positioned on the bowler, the washable towel member is positioned between the bowling ball and the bowler's chest area thereby preventing dirt from the ball from being transmitted to the bowler's shirt.

DESCRIPTION OF THE PREFERRED EMBODIMENT

Figure 2:
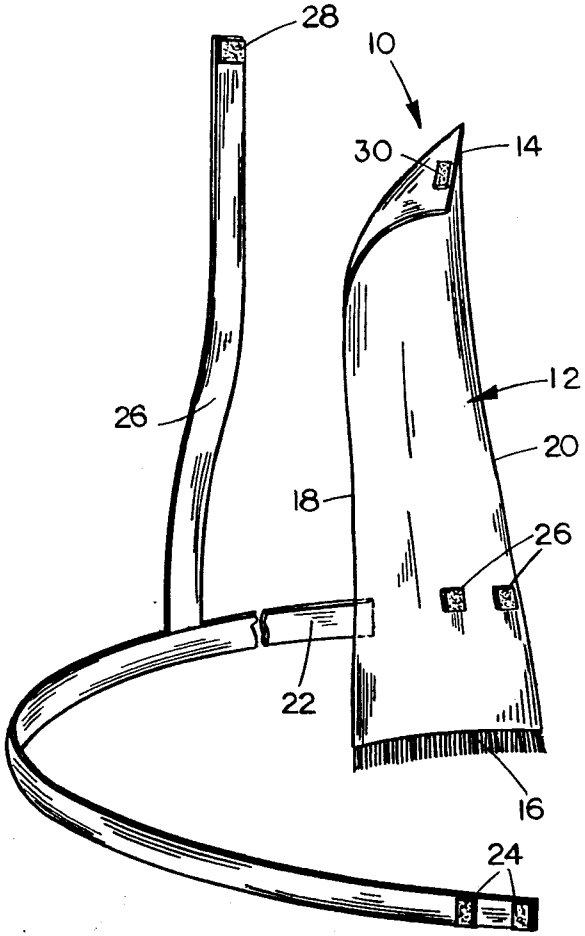
FIG. 2 is a perspective view of the protective garment of this invention.
Figure 1:
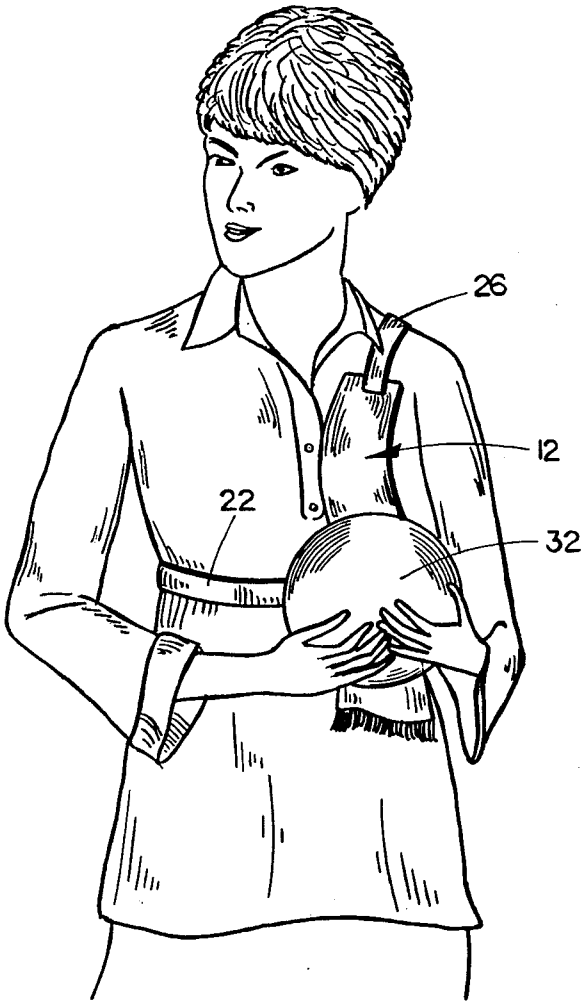
FIG. 1 is a front view of the protective garment of this invention positioned on a bowler.

The protective garment of this invention is referred to generally by the reference numeral 10 and is designed to be worn by a bowler as illustrated in FIG. 1. Garment 10 generally includes a washable towel member 12 having an upper end 14, lower end 16 and opposite side edges 18 and 20. An elongated strap 22 is secured at one end to the rectangular towel member 12 adjacent side edge 18 and is adapted to be extended around the wearer's waist. The other end of the strap member 2 is provided with VELCRO fastener elements 24 which are adapted to be detachably connected to the VELCRO fastener elements 26 on the backside of the rectangular member 12.

An elongated strap 26 is secured to strap member 22 intermediate the length thereof and is provided with a VELCRO fastener 28 at its other end which is adapted to be secured to the VELCRO fastener 30 on the upper forward side of the rectangular member 12.

In use, the VELCRO fastener 28 would normally be secured to the VELCRO fastener 30 and the left arm of the bowler is then inserted through the opening formed by the strap member 26 and towel 12. The rectangular towel member 12 is positioned over the chest or breast area of the bowler as illustrated in FIG. 1. Strap member 22 is then extended around the bowler's waist with the VELCRO fasteners 24 being secured to the VELCRO fasteners 26. When the bowler picks up the bowling ball 32 as illustrated in FIG. 1, the rectangular towel member 12 will be positioned between the ball and the bowler's shirt. Thus it can be seen that the garment prevents dirt from being transmitted to the bowler's shirt. It can also be seen that the garment 12 does not interfere with the movement of the bowler's arms so as not to interfere with the delivery of the ball. After the bowler has completed bowling, the device may be removed and washed for subsequent use.

Although the protective garment of this invention has been described as being positioned over the left chest or breast area, it should be noted that the garment could be designed to fit over the right chest or breast area.

Thus it can be seen that a novel protective garment has been provided which is ideally suited for a bowler to prevent the bowler's shirt from becoming dirty during bowling.

I claim:

1. A protective garment for a bowler, comprising, a generally rectangular member having upper and lower ends adapted to be positioned over one of the bowler's breasts and generally extending from the bowler's shoulder to the bowler's waist, a first elongated strap member secured at one end to said rectangular member above the lower end and adapted to be extended around the bowler's waist and detachably secured at its other end to said rectangular member, a second elongated strap member secured at one end to the upper end of said rectangular member and adapted to extend therefrom over the bowler's shoulder and thence downwardly behind the bowler's back for connection, at its other end, to said first strap member intermediate the ends thereof.

2. The garment of claim 1 wherein VELCRO connectors detachably secure said second strap member to said rectangular member.

3. The garment of claim 1 wherein VELCRO connectors detachably secure said second strap member to said rectangular member.

4. The garment of claim 1 wherein said rectangular member is comprised of a towel member.

* * * * *